US005307651A

United States Patent [19]

Felzer

[11] Patent Number: 5,307,651

[45] Date of Patent: May 3, 1994

[54] WASHING MACHINE

[76] Inventor: William Felzer, 2925 Rivera St., San Francisco, Calif. 94116

[21] Appl. No.: 64,720

[22] Filed: May 19, 1993

[51] Int. Cl.[5] ..... D06F 17/04; D06F 23/04

[52] U.S. Cl. ..... 68/23.5; 68/205 R

[58] Field of Search ..... 68/23 R, 23.5, 184, 68/205 R, 207

[56] References Cited

U.S. PATENT DOCUMENTS

| | | | |
|---|---|---|---|
| 1,474,277 | 11/1923 | Martel et al. | 68/184 |
| 1,783,415 | 12/1930 | Dehle | 68/184 |
| 2,101,634 | 12/1937 | Aldridge | 68/23.5 |
| 2,331,379 | 10/1943 | Dyer | 68/184 |
| 2,358,691 | 9/1944 | Dehle | 68/184 |
| 2,711,641 | 6/1955 | Groff | 68/184 |
| 2,969,665 | 1/1961 | Saverio | 68/184 |
| 3,664,159 | 5/1972 | Mazza | 68/205 R |
| 3,868,835 | 3/1975 | Todd-Reeve . | |
| 4,325,235 | 4/1982 | Bauer | 68/3 SS |
| 4,744,228 | 5/1988 | Goldberg | 68/20 |
| 5,161,394 | 11/1992 | Felzer et al. | 68/184 |

FOREIGN PATENT DOCUMENTS

| | | | |
|---|---|---|---|
| 498318 | 10/1950 | Belgium | 68/23.5 |
| 1145503 | 5/1957 | France | 68/184 |
| 440583 | 10/1948 | Italy | 68/23.5 |

*Primary Examiner*—Philip R. Coe

[57] ABSTRACT

A laundry machine constructed to discharge liquid from rotating nozzles into a basket, impacting and agitating fabrics and clothes within basket. Nozzles are located under cover door and above basket. Pump recirculates the liquid and the reaction force of the liquid flowing through the nozzles rotates nozzles. Spin rotation of the basket extracts liquid from fabrics and clothes.

2 Claims, 3 Drawing Sheets

WASHING MACHINE

1. FIELD OF INVENTION

This invention relates to improvements made to washing machines for fabrics and clothing specifically the replacement of paddle agitators, nozzles within the tub, with rotating nozzles located above the basket and discharging liquid into basket.

2. Description of Prior Art

The washing of fabrics and clothes has occurred throughout recorded human history. Some methods of accomplishing the washing includes: the impact of pounding clothes on rocks, the rubbing of clothes against a washboard or other rough surface, the water motion of a flowing stream, the rocking motion of clothes in a tub, the stationary soaking of clothes in a tub, spraying water onto hanging clothes, the vertical pulsation of an agitator in a tub, the reversing circular motion of an agitator in a tub, the oscillation motion of a tub having paddles on its inside surface, the use of sonic(or ultrasonic) pulses via an agitator, the oscillation of a drum about its horizontal axis, the use of jets within the liquid in a tub and or basket and the use of jets for levitating and agitating clothes in a basket.

The present embodiment of the washing machine is distinguished from most prior art (a) by the absence of a paddle agitator, (b) the absence of abrasive action to effectuate cleaning, (c) the absence of jets within the tub and or basket, and (d) the presence of rotating nozzles located above the basket and discharging rotating jets of liquid into the basket and impacting the liquid and fabrics and clothes within the basket.

The present embodiment is distinguished from the machines apparently similar as follows:

U.S. Pat. No. 1,474,277 (Martel et al., 1923) uses a tub with side-mounted nozzles at different heights directing. In contrast, my invention has rotating nozzles discharging liquid into the surface of the liquid in the basket.

U.S. Pat. No. 2,331,379 (Dyer, 1943) shows horizontal nozzles directing liquid inward over a false bottom from a central pump. In contrast, my invention has rotating nozzles directing liquid jets generally downward into the basket and no claim is made for central pump mounting.

U.S. Pat. No. 2,358,691 (Dehle, 1944) directs water jets upward through the bottom of a water-filled tub to produce agitation in the water-filled tub. In contrast, my invention has rotating nozzles, located above the basket, that discharges liquid into the basket, impacting and agitating the fabrics and clothes within the basket.

U.S. Pat. No. 2,711,641 (Groff, 1955) operates by a rotary valve alternately directing water to various upwardly-directed and downwardly-directed nozzles within the liquid in the tub to achieve agitation by jet nozzles facing each other. A separate spin basket is not claimed or shown. In contrast, my invention does not rely on mechanical valves to modulate water pressure and flow rate alternately. My invention incorporates spin extraction and the rotating nozzles are located above the basket.

U.S. Pat. No. 2,969,665 (Saverio, 1961) shows a basket inside a tub, at the bottom of which is a centered centrifugal pump, so arranged that its impeller directs washing liquid into upward arcs by deflecting liquid emerging from its impeller. In contrast my invention has rotating nozzles discharging liquid into the surface of the liquid in the basket for creating liquid turbulence.

U.S. Pat. No. 3,664,159 (Mazza, 1972) teaches a device for cleaning clothing hung on a plurality of support members built into the top of a cabinet directing liquid upon the vertically hanging articles, using a shaking action for dewatering. In contrast, my invention uses a tub and clothes basket without the hanging of garments, and spin drying is present.

U.S. Pat. No. 4,325,235 (Bauer, 1982) shows an agitatorless machine deriving its motive power from water pressure in the supply hose, combined with the introduction of air, which features are not claimed herein. Spin drying is not shown. The water is discharged within the liquid in the tub. There is far more turbulence and agitation caused by discharging jets of liquid into the tank from above and as a result more agitation of the clothes to be cleaned.

U.S. Pat. No. 4,744,228 (Goldberg, 1988) shows a jet entering the bottom of a tub full of water being circulated by torroidal water flow path for agitation, with the spin accomplished by magnetic coupling through the non-magnetic (plastic) tub bottom, and a readily removable tub than can be transferred to a clothes dryer. In contrast, my invention discharges the rotating liquid jet into the surface of the liquid in the basket creating much more turbulence in the liquid for agitating the fabrics and clothes and the absence of any claim for the material of construction or magnetic drive for the basket in the tub.

U.S. Pat. No. 5,161,394 (Felzer et al.) shows fixed nozzles located within a fixed tub, discharging liquid jets through holes in bottom of a basket. The liquid impacts and levitates the clothes within basket. In my invention rotating nozzles outside of the basket discharges liquid jets into the basket creating waves and turbulence within the basket and agitating the fabrics and clothes. The liquid drains from the top to the sides and bottom of the basket affecting all the fabrics and clothes within basket.

French Patent No. 1,145,503 (Moulin, 1957) shows a single tub with both upwardly and downwardly pointing nozzles agitating the clothing and separate skimming liquid paths. It does not show spin extraction. In contrast, my invention uses a basket inside a tub and one motor for pump and spin extraction.

In Dyer, Dehle, Groff, Saverio and Moulin, the energy of the jets is inefficiently dissipated when it impacts a body of liquid from within. In Felzer et al., the energy of impact is directed to the bottom layer of clothes and sufficient energy of agitation may not reach the top layers of fabrocs and clothes. In my invention, the rotating jets of liquid causes turbulence over the entire surface of the liquid in the basket and this turbulence is transmitted to agitate all the clothes within the basket. Other fields of washing use water spray. These uses are steam cleaners for automotive equipments and parts, pressure washers for building cleaning, spray nozzles without spin drying for dishwashers, manually operated hoses for spray cleaning, and clean-in-place spray nozzles for food tanks and food cooking equipment.

There have been hundreds of United States patents issued washing machine and components thereof. My searches have revealed none like my invention, either as patents or as published literature.

This invention differs from all of these examples of washing using nozzles in that there is no recorded prior art or patents using rotating nozzles above a basket for creating stormy conditions within a basket for agitating and cleaning clothing and fabrics after the manufacturing has been completed that also uses spin drying. This invention is not obvious as evidenced by the nultitude of patents already issued that teach away from or that do not teach or claim the methods herein for clothes washing.

The motivation to investigate washing machines was a desire to further simplify the design, use fewer and less expensive parts, to reduce manufacturing and maintenance costs, and increase the life of the washing machine. To eliminate parts with clearances that clog with soap sud residues and solidfy over a period of time making disassembly very difficult. Often these parts are damaged in disassembly and must be replaced.

OBJECTS AND ADVANTAGES

Several objects and advantages of my present invention are:

(a) to literally create storm conditions within the basket by a down pour of rotating liquid jets onto the liquid, fabrics and clothes within the basket. The impact of the rotating liquid jets and the pressure variations created within the liquid in the basket and the constant recirculation of the liquid within the basket agitates the fabrics and clothes. The nozzles discharging the liquid jets rotate because of the torque developed within the nozzles by the horizontal change in direction of the liquid flowing through the nozzles. The swivel for the nozzles about which the nozzles rotate is not precision and any leakage of liquid from the swivel falls into the basket;

b) to provide more space within the basket for more fabrics and clothes to wash;

(c) to minimize the number of openings in the tub;

(d) to simplify the design so that fewer and less complex parts are required;

(e) to reduce manufacturing and maintenance costs because of the simplification;

f) to reduce the weight of the washing machine by using a simpler method for agitating the contents within the basket; and g) to provide a machine which produces less clothing and fabric tangling, less tearing, loss of buttons and fasteners than current machines.

(a) to eliminate the need for oil by eliminating gear drives.

BRIEF DESCRIPTION OF DRAWING FIGURES

FIGS. 1 to 3 show various aspects of the present embodiment of the washing machine improvements.

FIG. 1 shows the basic features of the invention, notably the nozzles in relation to the cover and the top opening of the basket. It shows the configuration for recirculating the liquid between tub and nozzles. It shows the configuration for draining liquid from the tub to drain. It shows the configuration of the means for rotating the basket shaft and basket.

To those practicing the art, it is obvious that several variations of this teaching are possible.

Figure 4:
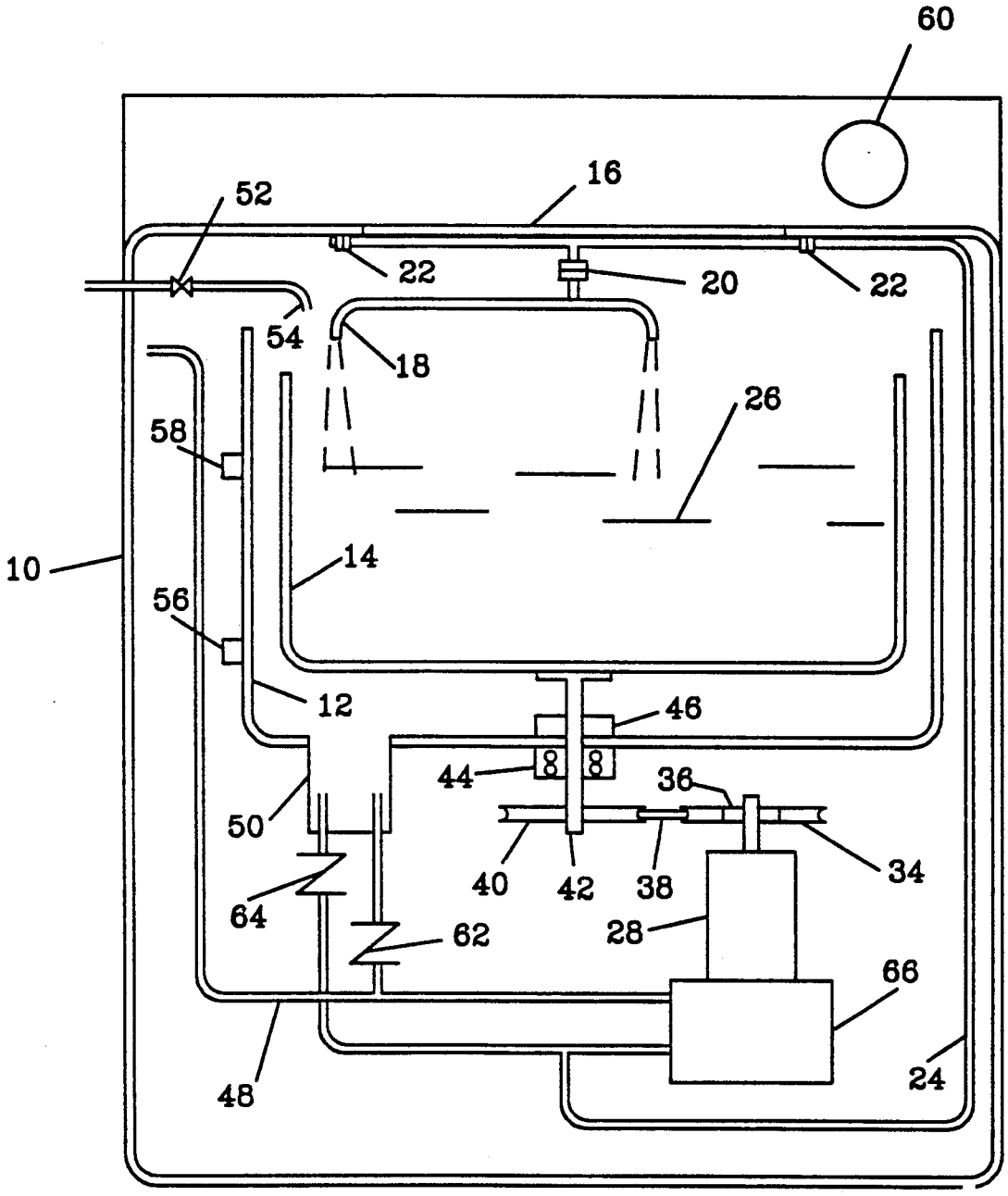

FIG. 4 is such a variation. It shows a pump that is capable of reversing liquid direction in and out of the pump by reversing rotation of the pump. It shows the configuration of liquid conduit and the placement of the check valves. The direction of rotation of the pump and the check valves will determine in which direction the liquid flows in the conduit.

| REFERENCE NUMERALS IN DRAWING | |
|---|---|
| 10 housing | 12 tub |
| 14 basket | 16 cover door |
| 18 nozzle | 20 nozzle swivel |
| 22 conduit swivel | 24 recirculating liquid conduit |
| 26 liquid | 28 motor |
| 30 recirculating pump | 32 drain pump |
| 34 basket spin pulley | 36 over running clutch |
| 38 basket spin belt | 40 basket shaft pulley |
| 42 basket shaft | 44 thrust and radical bearing combination |
| 46 shaft liquid seal | 48 drain liquid conduit |
| 50 trap | 52 solenoid valve |
| 54 water fill spout | 56 liquid low level sensor |
| 58 liquid high level sensor | 60 control panel |
| 62 check valve | 64 check valve |
| 66 reversible pump | |

Figure 1:
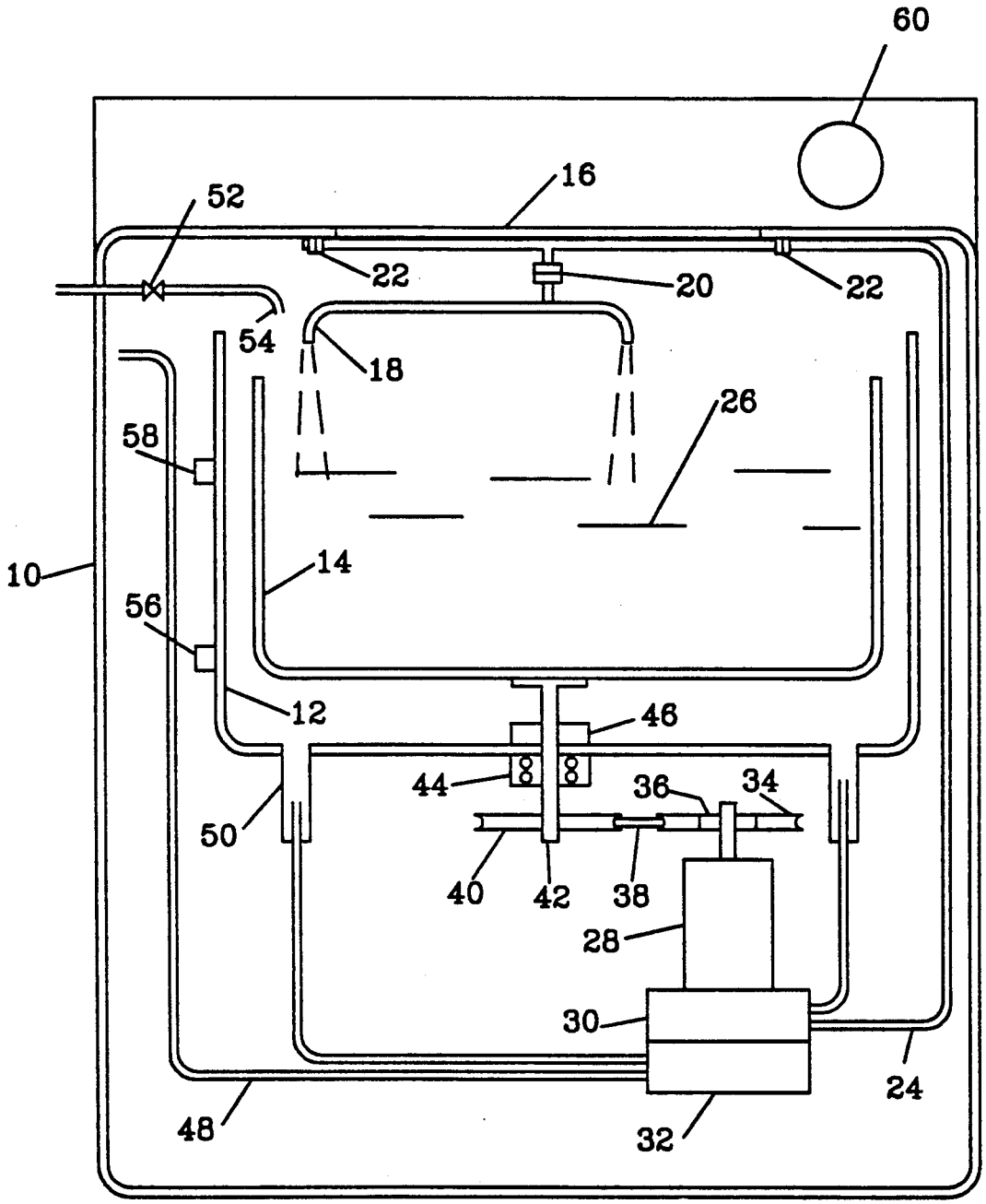
Figure 2:
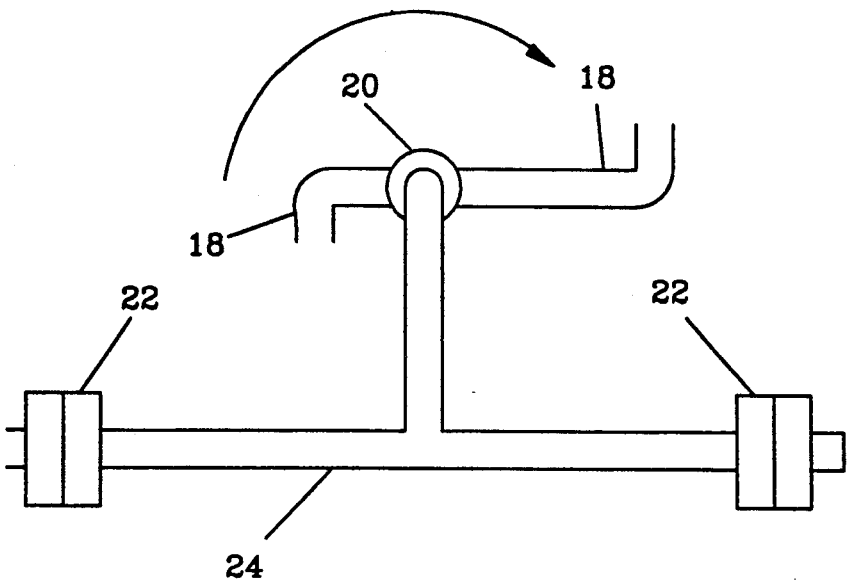
FIG. 2 shows the configuration of the nozzles, liquid conduit, and the liquid conduit swivels.
Figure 3:
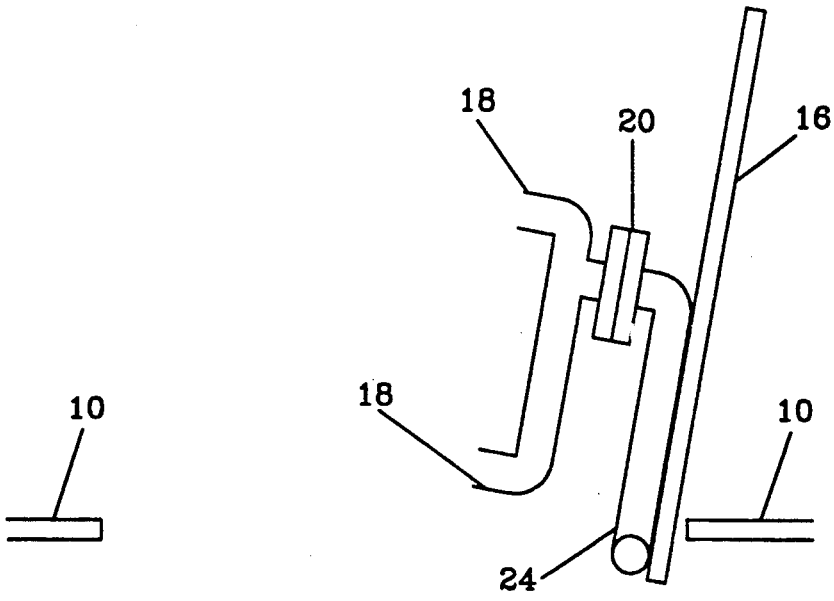
FIG. 3 shows the configuration of the cover door, the nozzles, and the nozzle swivel in the open position for loading and unloading of fabrics in basket.

DESCRIPTION OF PREFERRED EMBODIMENT OF INVENTION-FIGS. 1 to 3

A typical embodiment of the washing machine in FIG. 1 shows a housing 10 and cover door 16 that contains inside, nozzles 18 and a tub 12. Inside tub 12 is a perforated basket 14 held atop a basket shaft 42. Motor 28 rotates recirculating pump 30 which moves liquid 26 from tub 12 through trap 50, through recirculating liquid conduit 24, through liquid conduit swivel 22, through nozzle swivel 20, through nozzles 18 and into basket 14. Reversing rotation of motor 28 rotates basket 14 for spin drying and rotates drain pump 32 for draining tub 12 of liquid 26, and discharging liquid 26 through drain liquid conduit 48 to drain. Cover door 16, nozzle swivel 20, nozzles 18 and the section of circulating liquid conduit 24 between liquid conduit swivels 22 and attached to cover 16 can be rotated 90 degrees or more, opening housing 10 for loading and unloading basket 14 of fabrics and clothes. Motor 28 is reversible and mechanically coupled to recirculating pump 30 and drain pump 32. Leakage from tub 12 is prevented by its watertight construction and by shaft liquid seal 46. Liquid 26 consists of water, detergent, bleach, enzyime cleaners, solvent, or a combination thereof. Liquid 26 is contained by the tub 12, circulating pump 30, recirculating liquid conduit 24, drain pump 32, and drain liquid conduit 48. The sides and bottom of basket 14 are perforated for draining liquid 26 from within the basket 14 into tub 12. Liquid low level sensor 56 and liquid high level sensor 58 help control solenoid valve 52. The basket shaft 42 holds basket 14 on one end and is supported by radial and thrust bearings 44 and attached to basket shaft pulley 40 at other end. Motor 28 has over running clutch 36 and a basket spin pulley 34 attached thereto. A basket spin belt 38 is attached to basket spin pulley 34 and basket shaft pulley 40.

The housing 10 and components not specifically claimed as invention are essentially conventional.

FIG. 2 shows the top view arrangement of nozzles 18 in relation to center of rotation, liquid conduit swivels 22, recirculating liquid conduit 24.

FIG. 3 shows a side view of the cover door 16 in open position for loading and unloading fabrics and clothes in basket 14. The recirculation liquid conduit 24, between the liquid conduit siwvels 22 is attached to cover door 16 and connected to nozzle swivel 20.

FIG. 4 shows an alternate embodiment of the invention. The recirculation pump 30 and drain pump 32 in FIG. 1 are replaced by reversible pump 66 and the recirculating liquid conduit 24 and the drain liquid conduit 48 are rearranged. Motor 28 rotates pump 66, recirculating liquid 26 from tub 12 through trap 50, through check valve 62, through drain liquid conduit 48, through pump 66, through recirculating liquid conduit 24, through liquid conduit swivel 22, through nozzle swivel 20, through nozzles 18 and discharging into basket 14. Back flow closes check valve 64 and prevents flow of liquid into tub 12. Reversing rotation of motor 28 reverses rotation of the pump 66 and pump 66 now functions as a drain pump moving liquid from tub 12, through trap 50, through check valve 64, through recirculating line 24, through pump 66, through drain liquid conduit 48 to drain. Back flow closes check valve 62 and prevents flow of liquid into tub 12. All other functions not described above are the same as in FIG. 1, to FIG. 3.

From the description above, a number of advantages of my washing machine becomes evident:

(a) The washing machine embodiment provides reduced manufacturing cost as a result of reduced complexity and weight from existing manufacturing, since a gear agitator drive, an agitator and oil are not used, and the need to align nozzles and holes and hold basket in a fixed position;

(b) The washing machine embodiment provides a machine that agitates by impact, turbulence and gravity draining of the liquid in the basket. Jets of liquid discharging upward through the bottom holes in a basket may not always agitate the top layers of fabrics and clothes in the basket.

(c) The washing machine embodiment provides a machine which produces less clothing and fabric tangling, less tearing, and less loss of buttons and fasteners than current machines, by means of absence of hard surface impact through the absence of an agitator.

SUMMARY, RAMIFICATIONS AND SCOPE

The reader will see that the washing machine directs large volumes of rotating liquid jets downward into the basket containing liquid, fabrics, clothes and creating a storm condition within the basket. The cleaning liquid impact, turbulence, and continual recirculating cleans the fabrics within the basket.

The invention will permit the use of less water in many instances because by draining downward from the top, all the clothes within the basket is subject to some agitation. The more water in the tub, the greater the turbulence and agitation within the tub. With this invention, lightly soiled fabrics and clothes require less liquid in the basket. This is opposed to filling a tub to a level immersing clothing and using mechanical agitation as is done presently in vertical-axis washing machines. Jetting liquid through the bottom holes of a fabric and clothes filled basket does not always reach the top layers of fabrics and clothes.

The washing machine will require less material weight to accomplish results substantially the same as accomplished by conventional washing machines, thereby using less mineral resources and less power to produce.

Frictional moving parts have been reduced to a minimum. Swivel parts are liquid lubricated and any leakage from the swivels falls into the basket or tub.

Maintenance cost should be considerably reduced because of the fewer and less complex parts involved and the ease of replacement. The life usuage of the washing machine should be increased because of the fewer working parts and the simplicity of the-design. Parts such as paddle wheel agitators which often freeze up because of soap residues have been eliminated. This invention will save oil by eliminating the gear train used in conventional washing machines. The impulses set-up by the non-pumping drain pump during the washing cycle contributes to the cleaning action of the clothes within the basket.

Although the description contains specifics, these should not be construed as limiting the scope of the invention. FIG. 4 illustrates the use of a reversible pump, and check valves to accomplish the same results.

The nozzles instead of rotating can be stationary, increased in number and discharge the liquid jets in an interrupted flow pattern to simulate rotating jets.

Thus the scope of the invention should be determined by the appended claims and their legal equivalent, rather than the examples given.

OPERATION OF THE PREFERRED EMBODIMENT OF THE INVENTION-FIGS. 1 TO 4.

Referring to FIG. 1, the manner of using our washing machine has the clothes and fabrics and the like being introduced into the basket 14 manually through cover door 16 after water or other components of liquid 26 have entered through inlet solenoid valve 52, motor 28 rotates recirculating pump 30 to move liquid 26 from tub 12 through trap 50, through recirculation liquid conduit 24, through liquid conduit swivel 22, through nozzle swivel 20 to nozzles 18. The horizontal change of direction of the liquid flow in the nozzles 18 reacts with a horizontal torque causing nozzles 18 to rotate about nozzle swivel 20. Liquid 26 is discharged from the nozzles 18 in a circular path into basket 14. The nozzles 18 are positioned at different radii from the center of rotation so that the maximum surface area of liquid 26 in a basket 14 is made turbulent by the discharged liquid 26 from nozzles 18.

Reversing motor 28 rotates drain pump 32 to move liquid 26 from tub 14, through trap 50, through drain liquid conduit 48 to drain.

Recirculating pump 30 produces a liquid pressure and flow rate adequate to wash the fabrics and clothes in basket 14 and drain pump 32 produces a pressure and flow rate adequate to drain tub 12 of liquid 26.

Referring to FIG. 2 shows the location of the nozzles 18, the recirculation liquid conduit 24, the liquid conduit swivels 22, In FIG. 3 shows the cover door 16, the nozzle swivel 20, the recirculation liquid conduit 24 in the open position for loading and unloading fabrics in basket 14.

In FIG. 4 the liquid passes through an alternate embodiment of recirculating liquid conduit 24 and drain liquid conduit 48, check valve 62 and check valve 64 control flow of liquid 26 out of tub 12 and prevent back flow of liquid 26 into tub 12. Motor 28 is reversible and pump 66 is capable upon reverse rotation of operating as a drain pump.

I claim:

1. A washing machine apparatus comprising:

(a) a tub, (b) a basket containing fabrics to be cleaned, said basket being disposed within said tub for draining a liquid from said basket into said tub, (c) a motor, (d) a pumping means connected to one end of said motor for recirculating said liquid between said basket and said tub, for draining said tub of said liquid upon reversing rotation of said pumping means, (e) a recirculating liquid conduit having two directly opposite ends and a third end, one of the said two directly opposite ends connected to the said pumping means for transferring said liquid from said pumping means to said recirculating liquid conduit, (f) two conduit swivels having each a pivoting end and a non pivoting end, said non pivoting end of one of said two conduit swivels connected to other end of said two directly opposite ends of said recirculating liquid conduit for transfer of said liquid through said recirculating liquid conduit to said non pivoting end of one of said two conduit swivels, (g) a conduit having two opposite ends and a third end, said two opposite ends of said conduit connected to said pivoting ends of said two conduit swivels for support of said conduit, for transfer of said liquid through one of said two conduit swivels, for pivoting said conduit from a predetermined horizontal position of said conduit to a predetermined vertical position of said conduit for placement and removal of said fabrics from said basket, (h) a cover mounted on said conduit for supporting said conduit in a predetermined horizontal position when said cover is in a closed predetermined horizontal position, (i) a nozzle swivel having a nonrotating end, said nonrotating end connected to said third end of said conduit for support of said nozzle swivel and for transferring said liquid through said conduit to said nonrotating end of said nozzle swivel, (j) a rotating end of said nozzle swivel connected to said nonrotating end of said nozzle swivel for rotation of said rotating end of said nozzle swivel and for transfer of said liquid through said nonrotating end to said rotating end of said nozzle swivel, (k) a plurality of nozzles connected to said rotating end of said nozzle swivel for transfer of said liquid through said rotating end of said nozzle swivel to said plurality of nozzles, for rotation of said plurality of nozzles, for discharge of said liquid from said plurality of nozzles in circular paths into said basket, said plurality of nozzles mounted above and outside of said basket, (l) two check valves having inlet ends connected to said tub for draining said liquid from said tub and for preventing said liquid from entering said tub through said two check valves, (m) an outlet end of one of said two check valves connected to said third end of said recirculating liquid conduit for transferring said liquid from said tub to said pumping means upon reverse operation of said pumping means, (n) a drain liquid conduit having two opposite ends and a third end, one of said two opposite ends connected to said pumping means for tranferring said liquid in said drain liquid conduit to said pumping means, (o) an outlet end of other one of said two check valves connected to other one of said two opposite ends of said drain liquid conduit, for tranferring said liquid through said outlet end of other one of said two check valves into said drain liquid conduit, (p) a third end of said drain liquid conduit having a predetermined vertical height above said two check valves, for preventing gravity draining of said liquid from said tub into atmosphere, for discharging said liquid upon reverse operation of said pumping means, (q) an over running clutch means connected to other end of said motor for transmitting rotational energy when said motor operates in reverse rotation, (r) a belt connected to said over running clutch means for transmitting rotational energy from said over running clutch to said belt, (s) a pulley connected to said belt for transmitting rotational energy from said belt to said pulley, (t) a shaft connected at one end to said pulley for transmitting rotational energy from said pulley to said shaft, and (u) other end of said shaft connected to said basket for transmitting rotation of said shaft to said basket for spin drying of said fabrics in said basket.

2. A washing machine apparatus as recited in claim 1 in which, (a) bores of said plurality of nozzles having a predetermined circular shape for minimizing pressure losses in said liquid flowing through said bores of said plurality of nozzles, (b) cross-sectional areas of said bores of said plurality of nozzles having a predetermined same size of said cross-sectional areas throughout said bores of said plurality of nozzles for discharging solid and full streams of said liquid into said basket, (c) ends of said plurality of nozzles having a predetermined curvature for discharging said liquid into said basket, for changing the direction of flow of said liquid in said ends and creating a rotating torque in said plurality of nozzles for rotating said plurality of nozzles, and (d) lengths of said plurality of nozzles having each a predetermined different size for discharging said liquid onto different areas in said basket.

* * * * *